US006637478B2

(12) United States Patent
Jungmann et al.

(10) Patent No.: US 6,637,478 B2
(45) Date of Patent: Oct. 28, 2003

(54) FILL STATION FOR A LIQUID DISPENSING SYSTEM

(75) Inventors: Ronald D. Jungmann, Maplewood, MN (US); Gregory B. Laughland, Rochester, MN (US)

(73) Assignee: Ecolab Inc., Mendota Heights, MN (US)

( * ) Notice: Subject to any disclaimer, the term of this patent is extended or adjusted under 35 U.S.C. 154(b) by 0 days.

(21) Appl. No.: 10/103,406

(22) Filed: Mar. 20, 2002

(65) Prior Publication Data

US 2003/0010397 A1 Jan. 16, 2003

Related U.S. Application Data

(60) Provisional application No. 60/304,587, filed on Jul. 10, 2001, and provisional application No. 60/312,587, filed on Aug. 15, 2001.

(51) Int. Cl.[7] ..... B67D 5/00

(52) U.S. Cl. ..... 141/378; 141/86; 141/87; 141/94; 141/104; 141/105; 141/360; 141/361

(58) Field of Search ..... 141/9, 94, 86–88, 141/100, 104–107, 18, 21, 351, 360, 361, 369, 370, 378–380

(56) References Cited

U.S. PATENT DOCUMENTS

| | | | | | |
|---|---|---|---|---|---|
| 244,378 | A | * | 7/1881 | Clark | 141/237 |
| 1,655,533 | A | * | 1/1928 | Campagna | 141/378 |
| 3,743,598 | A | | 7/1973 | Field | 210/49 |
| 4,858,449 | A | | 8/1989 | Lehn | 68/12 |
| 4,911,212 | A | * | 3/1990 | Burton | 141/369 |
| 4,944,332 | A | * | 7/1990 | Belland | 141/1 |
| 4,964,185 | A | | 10/1990 | Lehn | 8/158 |
| 4,976,137 | A | | 12/1990 | Decker et al. | 73/53 |
| 5,161,455 | A | * | 11/1992 | Anson et al. | 99/280 |
| 5,203,366 | A | | 4/1993 | Czeck et al. | 137/3 |
| 5,240,326 | A | | 8/1993 | Evanson | 366/139 |
| 5,279,448 | A | | 1/1994 | Hanlin et al. | 222/132 |
| 5,332,312 | A | | 7/1994 | Evanson | 366/136 |
| 5,683,011 | A | * | 11/1997 | Miliani | 222/56 |
| 5,769,536 | A | | 6/1998 | Kotylak | 366/136 |
| 5,782,380 | A | * | 7/1998 | DiSanto | 222/2 |
| 5,865,094 | A | * | 2/1999 | Kealy | 99/291 |

FOREIGN PATENT DOCUMENTS

| | | |
|---|---|---|
| WO | WO 9315828 | 8/1993 |
| WO | WO 9842786 | 10/1998 |

* cited by examiner

*Primary Examiner*—J. Casimer Jacyna
(74) *Attorney, Agent, or Firm*—Merchant & Gould P.C.

(57) ABSTRACT

A fill station for filling various sizes of containers from a liquid dispensing system includes a first stationary platform and second rotatable platform positioned above the first platform. The second platform is hinged to move between a horizontal loading position and a stowed position to provide access to the first platform. A third platform may be positioned above the second platform, wherein the third platform is hinged at an opposite end from the second platform to move between a horizontal load position and a stowed position. Sensors may be used to detect whether a container is positioned on one of the platforms and to detect the positions of the different rotatable platforms.

26 Claims, 6 Drawing Sheets

FILL STATION FOR A LIQUID DISPENSING SYSTEM

RELATED APPLICATIONS

This application claims priority of U.S. provisional application Serial No. 60/304,587, entitled "Flow-Based Chemical Dispense Control System," filed Jul. 10, 2001, and U.S. provisional application Serial No. 60/312,587, entitled "Fill Station And Application-Based Allocator And Formulator For A Chemical Dispense Control System," filed Aug. 15, 2001.

TECHNICAL FIELD

The invention relates generally to apparatus for dispensing a chemical product and, more particularly, to a fill station for filling containers of various sizes with the chemical product.

BACKGROUND OF THE INVENTION

Chemical dispensing systems are widely used to provide for proper mixtures and allocations of a specific chemical formula. Such systems typically direct a predetermined amount of a chemical formula to a fill station where a container is positioned to receive the chemical mixture. The fill station provides a base for supporting the container during the filling operation and further provides a drain for the removal of accidental spills that occur while filling the container.

In order to accommodate a plurality of different container sizes, prior art fill stations have utilized various techniques to ensure that the container opening is properly positioned relative to a chemical product discharge tube. One previous technique utilizes a height-adjustable platform or lift upon which each container would sit. The lift could be raised or lowered to the proper position prior to the filling operation. For safety reasons, a sliding gate would typically be used in conjunction with the lift to help prevent movement of the container during the filling operation. However, due to the time required to raise and lower the lift to the proper position, it is known that fill station operators would occasionally attempt to fill a container while the lift is improperly positioned. For example, an operator may attempt to fill a small container while the lift is set at lower level that is more appropriate for a larger container. This type of operation often results in chemical spillage, such as when the operator has not perfectly aligned the small container directly under the chemical discharge tube. Additionally, due to the time required to raise and lower the sliding gate between each filling operation, it is not uncommon for fill station operators to forego the requirement of lowering the sliding gate during the filling operation, thereby compromising safety while filling the container.

The above types of fill station operator "errors," as well as other errors such as forgetting to place a container under the product discharge tube, can be costly in a large scale chemical dispensing operation. Thus, an improved fill station is needed that will reduce or prevent chemical spillage as multiple containers of different sizes are filled at the fill station. It is with respect to these and other background considerations, limitations and problems that the present invention has evolved.

SUMMARY OF THE INVENTION

The above and other problems are solved by a fill station that utilizes one or more rotatable platforms to accommodate filling containers of varying sizes while maintaining a top or spout of each container at a specified location below a product discharge tube of a liquid dispensing system.

In accordance with one embodiment of the present invention, a fill station includes a first platform positioned above a drain outlet for holding a first container and a second platform positioned above the first platform for holding a second container smaller in size than the first container. The second platform is hinged to move between a horizontal loading position for holding the second container and a stowed position to provide access to the first platform for loading the first container on the first platform. A sensor is preferably used to detect whether a container is positioned on one of the platforms to receive product from a discharge tube of the liquid dispensing system. Additionally, a position sensor may be used to determine whether the second platform is in the horizontal loading position.

In one preferred embodiment, the fill station includes a third platform positioned above the second platform for holding a third container smaller in size than the second container. The third platform is also hinged to move between a horizontal loading position for holding the third container and a stowed position to provide access to the first and second platforms. Preferably, the second and third platforms are hinged at opposite ends so that the second and third platforms open in opposite directions and are stowed on opposite sides of the fill station when access to the first platform is desired.

In another embodiment of the present invention, a fill station includes a frame having a bottom wall, a rear wall, left and right side walls, and a lower front wall. The walls combine to form a drain pan, and the bottom wall includes a drain outlet. The fill station includes a bottom platform positioned above the drain outlet wherein the bottom platform is adapted to position a large-sized container beneath a product discharge tube of the liquid dispensing system. The fill station also includes a middle platform positioned above the bottom platform, wherein the middle platform is adapted to properly position a medium-sized container beneath the product discharge tube of the liquid dispensing system. The middle platform is hinged at one end to move between a horizontal loading position for holding the medium-sized container and a substantially vertical stowed position for providing access to the bottom platform. A top platform is positioned above the middle platform and is adapted to properly position a small-sized container beneath the product discharge tube of the liquid dispensing system. The top platform is hinged at one end opposite the hinged end of the middle platform to move between a horizontal loading position and a substantially vertical stowed position for providing access to the middle platform.

In one preferred embodiment, the fill station includes a sensor for detecting whether a container is positioned on one of the platforms in proximity to the product discharge tube of the liquid dispensing system. In further preferred embodiments, the fill station includes position sensors for determining the position of each of the middle and top platforms. These sensors can, in turn, be used to determine the size of the container positioned within the fill station.

The great utility of the invention is the ability to place containers of varying sizes within the fill station so that each container is properly positioned relative to a product discharge tube of a liquid dispensing system. The fill station achieves this end through the use of a plurality of stationary and rotatable platforms to accommodate the different sized containers. The present invention further verifies the presence of a container in the fill station and may also determine the position of the different rotatable platforms, thereby determining the size of the container present in the fill station. These and various other features as well as advantages, which characterize the present invention, will be apparent from a reading of the following detailed description and a review of the associated drawings.

DETAILED DESCRIPTION

Figure 1:
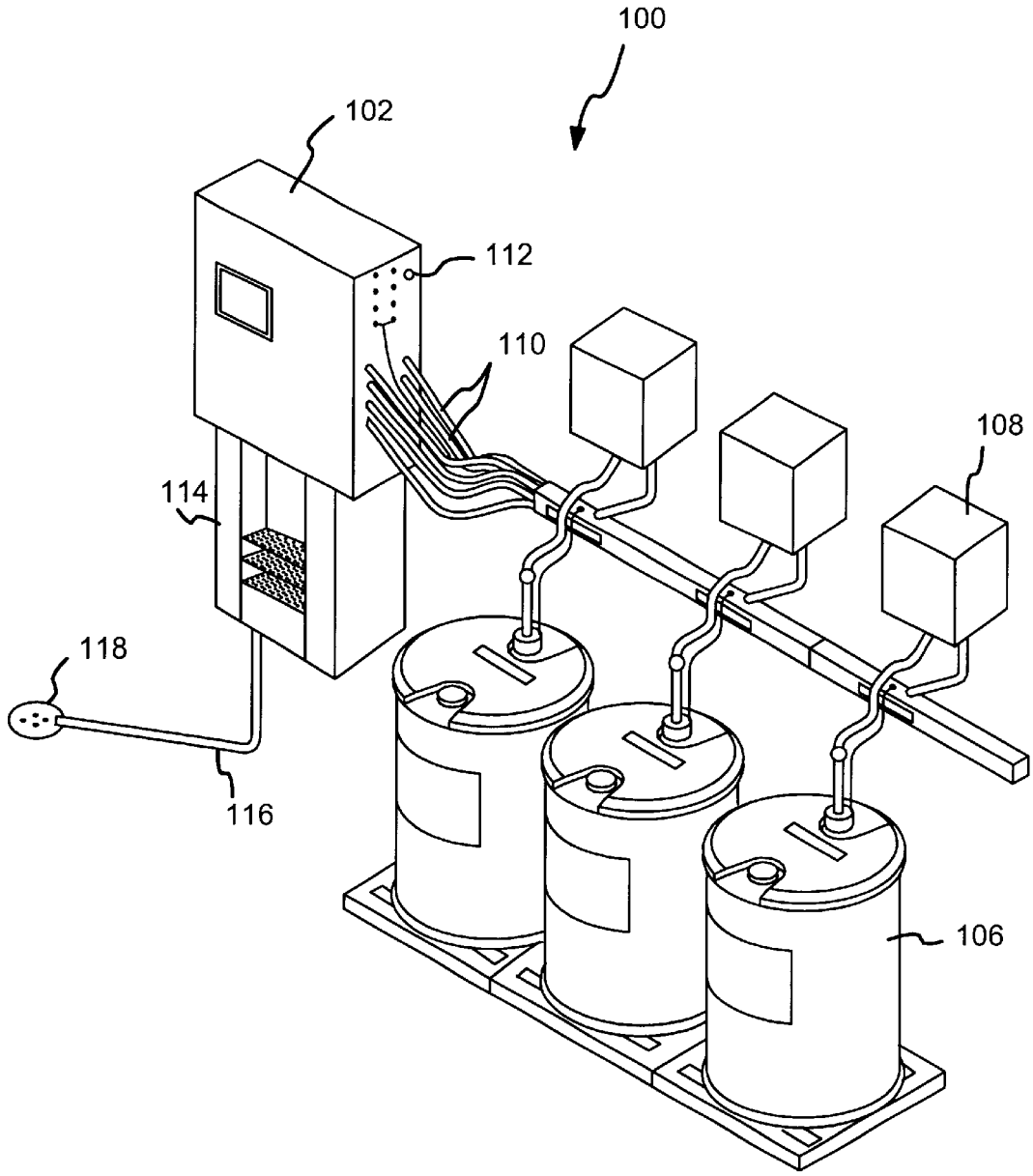
FIG. 1 is an isometric view of an exemplary chemical dispensing system incorporating a fill station in accordance with an embodiment of the present invention.
Figure 2:
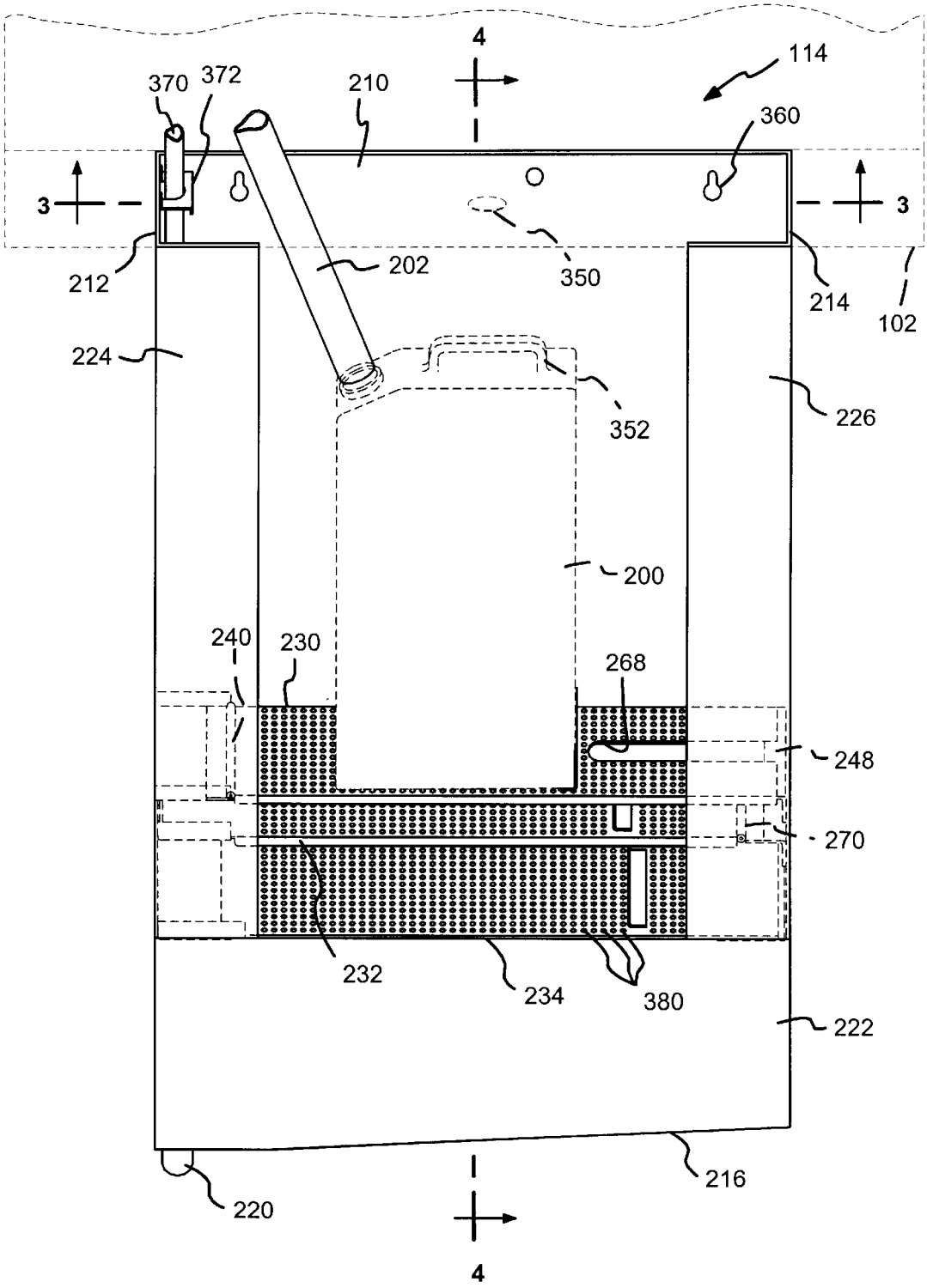
FIG. 2 is an enlarged isometric view of the fill station shown in FIG. 1 illustrating a relatively small container positioned on a top platform beneath a product discharge tube of the chemical dispensing system shown in FIG. 1, where both the container and a formulator above the container are shown in phantom as they represent external environmental features.

FIG. 1 illustrates an exemplary chemical dispensing system 100 for formulating and ultimately dispensing a chemical product to a container such as a jug 200 (FIG. 2). The exemplary chemical dispensing system 100 shown in FIG. 1 includes a formulator 102 that mixes a particular chemical product according to a specialized formula. The formulator 102 preferably accesses a plurality of concentrate containers 106 (three are shown in FIG. 1) by controlling concentrate pumps 108 attached to each container 106. The chemical concentrate is preferably transferred through individual lines 110 to the formulator 102. A water inlet 112 on the formulator 102 allows the formulator to mix the chemical concentrates with water prior to transferring the final chemical product to a fill station 114. Any excess chemical product is passed from the formulator 102 to the fill station 114 (as described below) where it is disposed of through a drain line 116 to a suitable drain 118 or other holding area.

Figure 3:
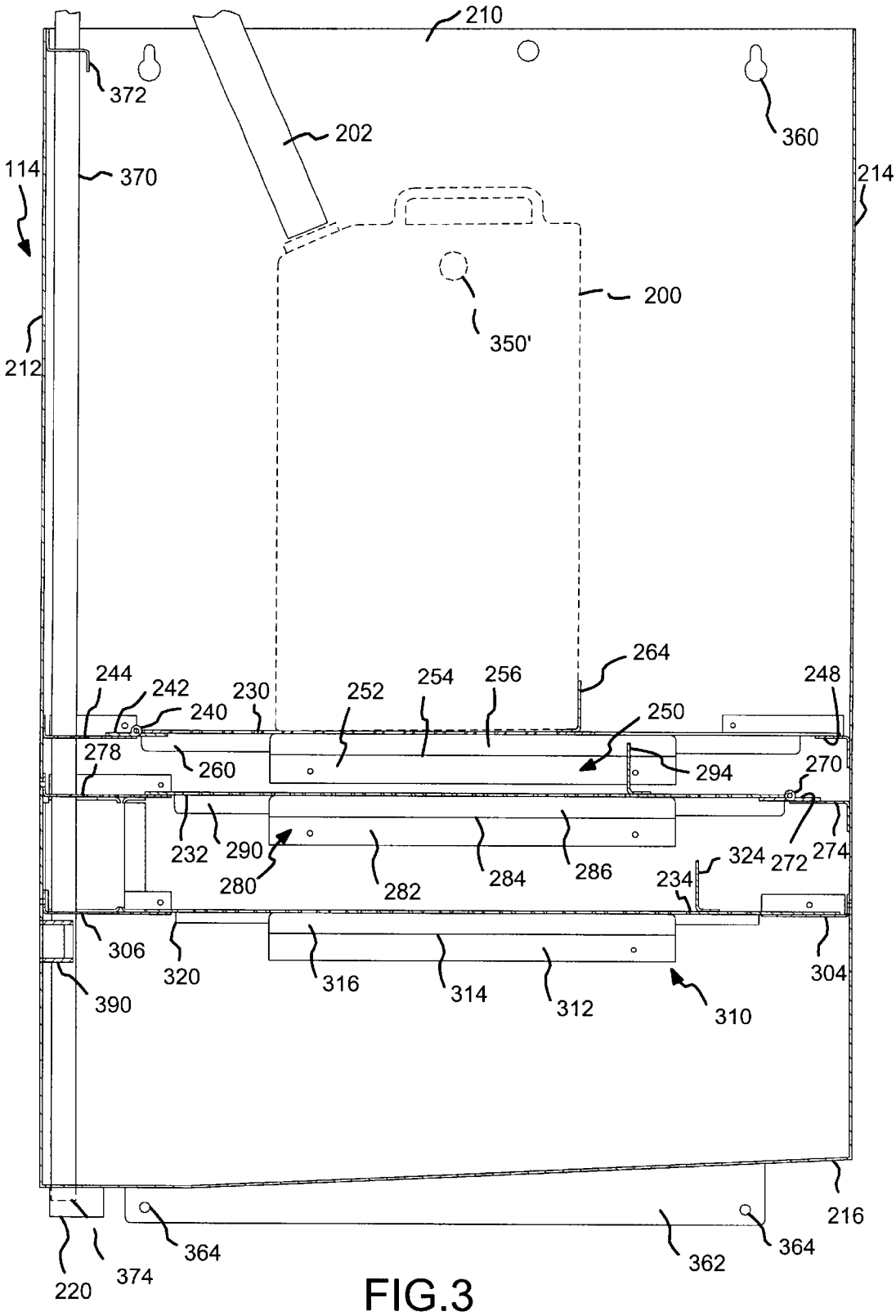
FIG. 3 is a section view of the fill station taken substantially along the line 3—3 in FIG. 2.
Figure 4:
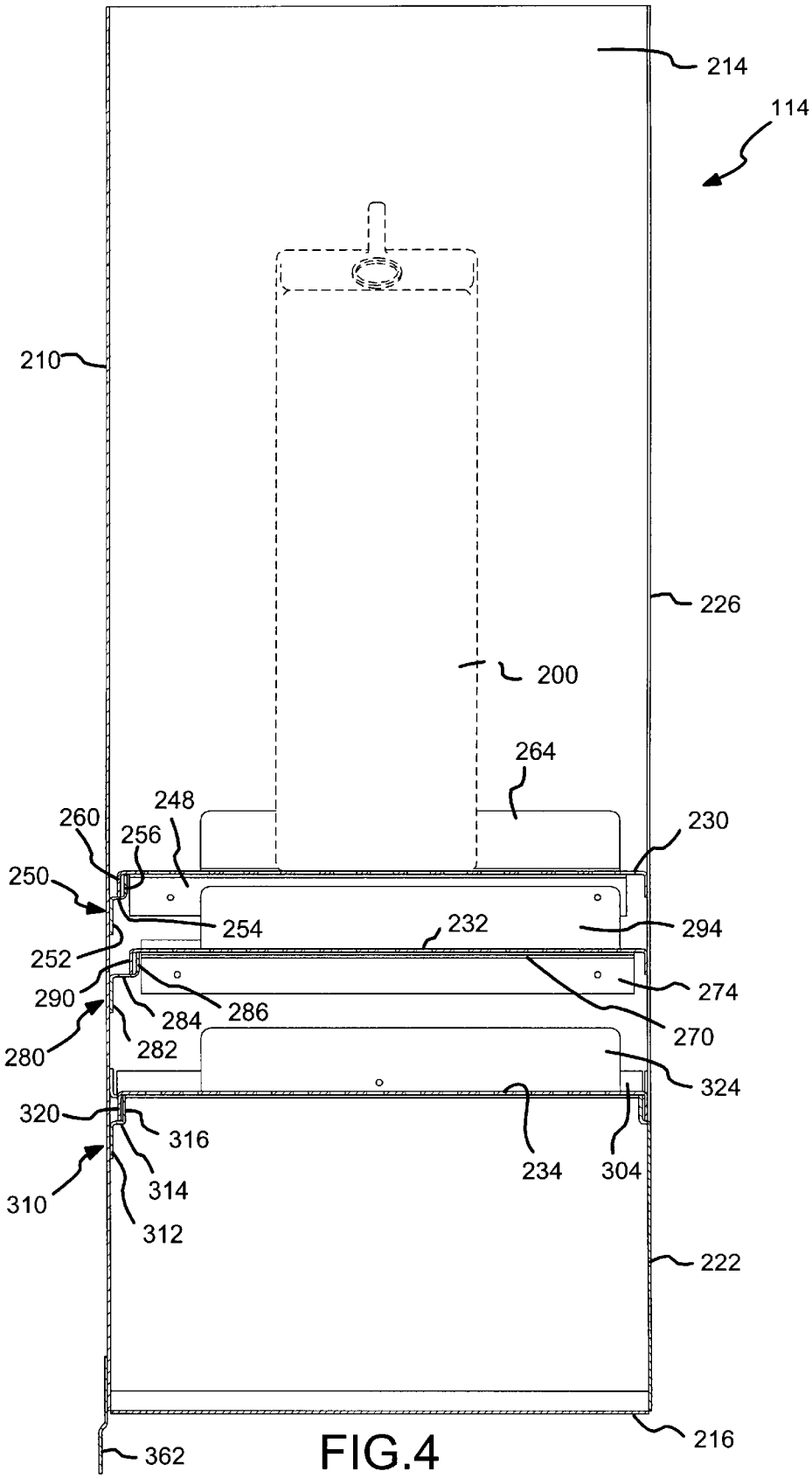
FIG. 4 is a section view of the fill station taken substantially along the line 4—4 in FIG. 2.

FIG. 2 illustrates an enlarged isometric view of the fill station 114 separately from the remainder of the chemical dispensing system 100. FIGS. 3 and 4 illustrate section views of the fill station 114, and each of the FIGS. 2–4 includes an illustration (in phantom) of a small-sized container 200 (e.g. 1.5 gallons) positioned in the fill station 114 to be filled from a product discharge tube 202 extending down from the formulator 102.

The fill station 114 is preferably substantially rectangular in shape with a rear wall 210, left and right side walls 212 and 214, respectively, and a bottom wall 216. The bottom wall 216 forms a drain pan and is preferably angled in the direction of the left side wall 212 as shown in FIG. 3. A drain outlet 220 (FIGS. 2 and 3) is preferably formed at the low point of the bottom wall 216 for connection to the drain line 116 (FIG. 1). A lower front wall or shroud 222 forms the final portion of the watertight drain pan, and two partial front walls 224 and 226 extend upward from the shroud 222 along each of the left and right side walls 212 and 214, respectively.

The two partial front walls 224 and 226 define an interior volume with the rear and side walls having a large open front extending between the two partial walls 224 and 226. The opening between the walls 224 and 226 provides access to a plurality of horizontal platforms arranged at different heights within the fill station 114. In the exemplary embodiment of the present invention described below, there are three different platforms 230, 232 and 234 that are used to support three different sizes of containers. Specifically, the top platform 230 preferably holds a 1.5 gallon container 200, while the middle platform 232 preferably holds a 2.5 gallon container 236 (FIG. 5) and the bottom platform 234 preferably holds a 5 gallon container 238 (FIG. 6). However, it is understood that the present invention may be used with either greater than or fewer than three different platforms.

The three platforms 230, 232 and 234 are positioned vertically atop one another and are separated from each other by predetermined distances according to the size of the container that each respective platform is designed to hold. Additionally, the top platform 230 and the middle platform 232 are hinged so that each platform can be raised to provide access to the platform immediately below as shown in FIGS. 2, 5 and 6.

Figure 5:
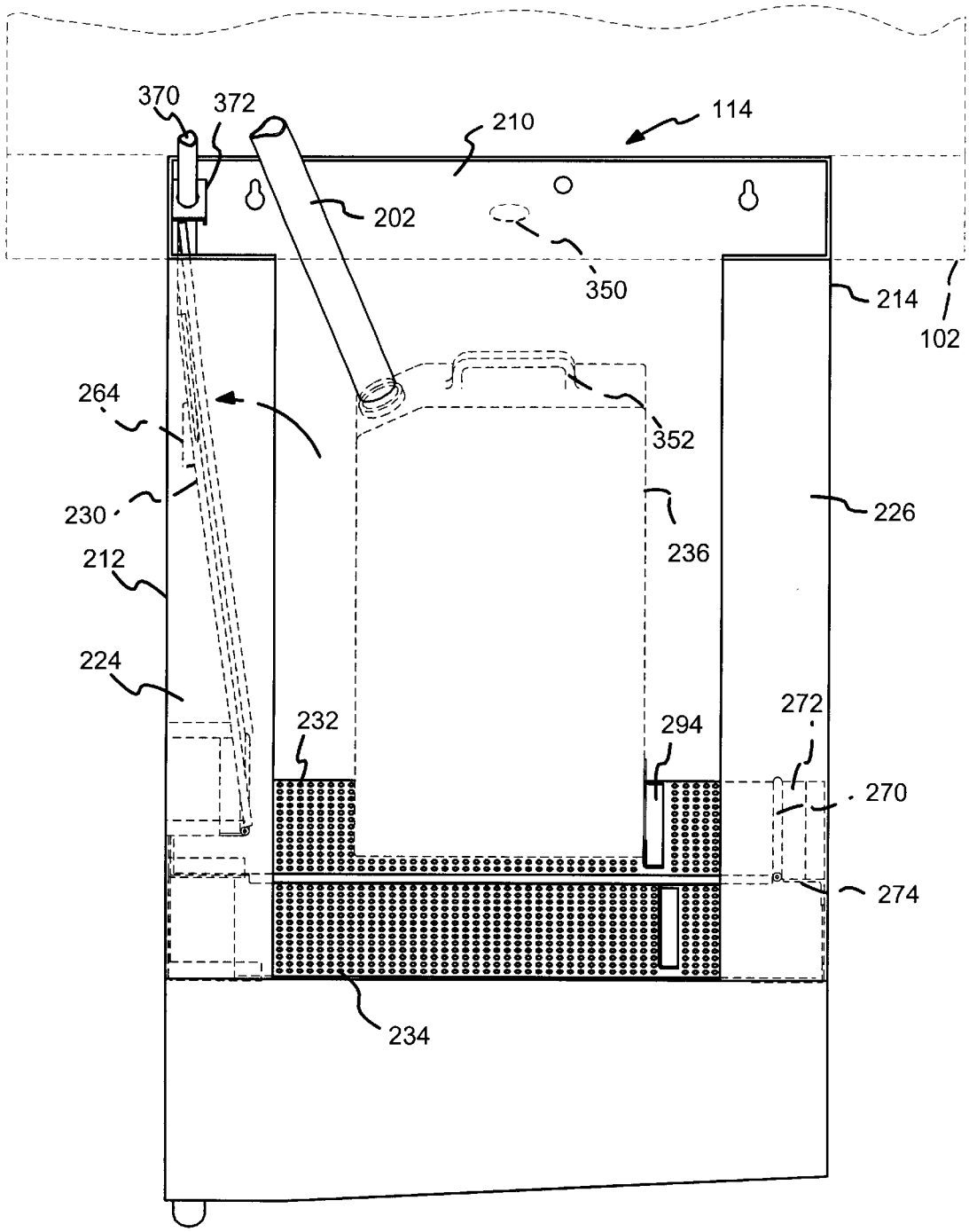
FIG. 5 is an enlarged isometric view of the fill station similar to FIG. 2 illustrating a medium sized container (shown in phantom) positioned on a middle platform of the fill station beneath the product discharge tube after the top platform has been raised to the left of the container as shown by the arrow.
Figure 6:
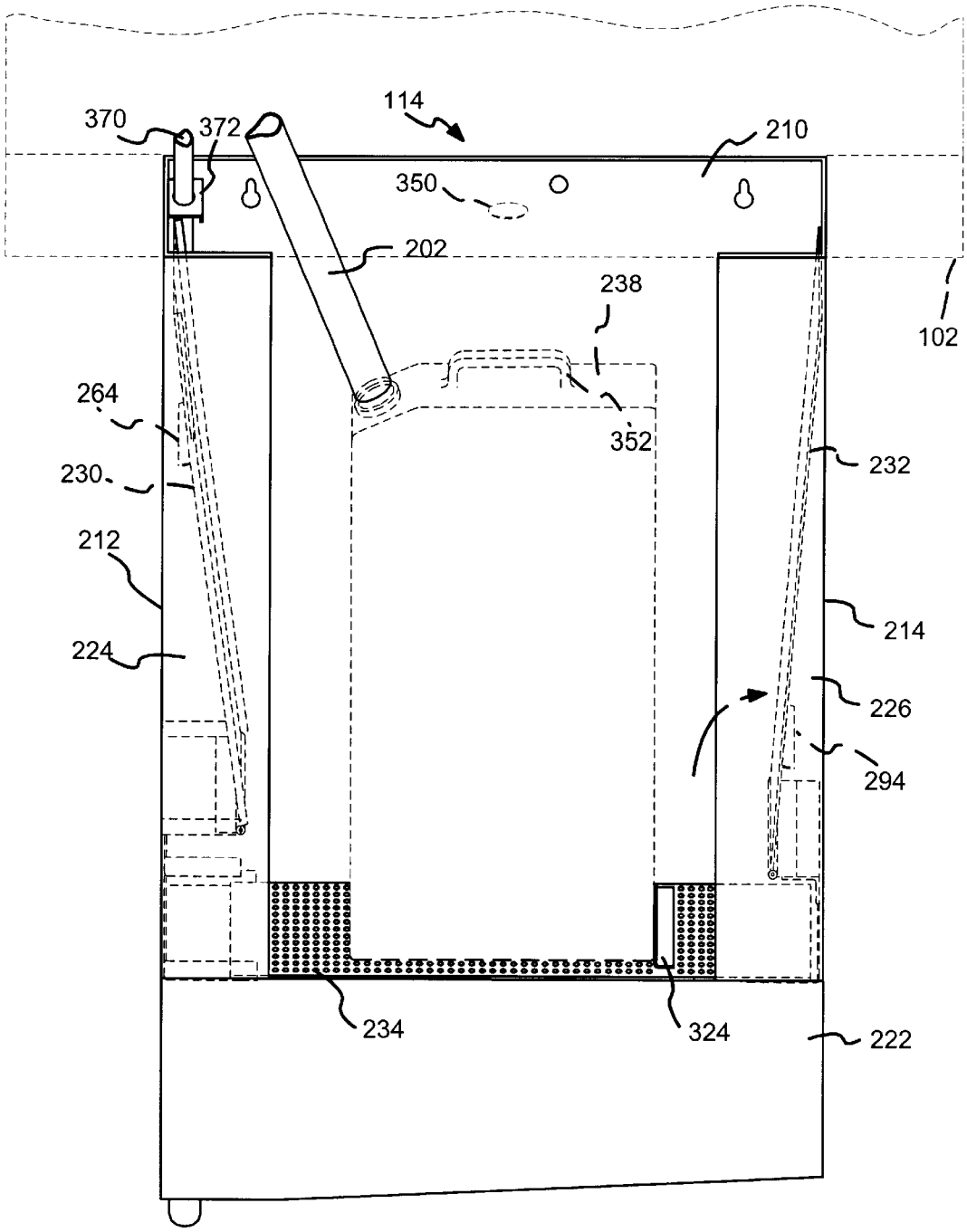
FIG. 6 is an enlarged isometric view of the fill station similar to FIGS. 2 and 5 illustrating a large sized container (shown in phantom) positioned on a bottom platform of the fill station beneath the product discharge tube after the middle platform has been raised to the right of the container as shown by the arrow.

FIG. 3 illustrates that the top platform 230 includes a hinge 240 attached to a left end of the platform 230 to allow the platform 230 to be raised against the left side wall 212 as shown in FIG. 5. Specifically, a fixed portion 242 of the hinge 240 is secured to a hinge angle or a horizontal mounting plate 244 that extends from the left side wall 212 between the rear wall 210 and the partial front wall 224 as shown in FIGS. 2 and 3. In this manner, the hinge 240 allows the top platform 230 to pivot about the hinge axis so that the free right end is lifted upward to a stowed position. In the horizontal loading position of the top platform 230 shown in FIGS. 2–4, the free right end of the platform 230 is supported by a horizontal stop 248 attached to the right side wall 214 and extending between the rear wall 210 and the partial front wall 226.

To provide added support for the top platform 230 (and specifically to keep the platform from sagging in the middle region where the container 200 is supported), an offset edge piece 250 is preferably attached along the rear wall 210 as shown in FIGS. 3 and 4. The offset edge piece 250 preferably comprises a double angle bracket having a first vertical segment 252 attached to the rear wall 210, a horizontal segment 254 extending laterally away from the rear wall 210, and a second vertical segment 256 extending upward from the horizontal segment 254. The second vertical segment 256 defines a horizontally extending edge that is offset from the rear wall 210 by the length of the horizontal segment 254. In this manner, the horizontally extending edge of the second vertical segment 256 supports a bottom surface of the top platform 230 when the platform 230 is in a horizontal loading position. Specifically, the horizontally extending edge of the second vertical segment 256 is preferably coplanar with a top surface of the horizontal stop 248 (and a top surface of the hinge 240) to provide a substantially horizontal support surface for the top platform 230 when the platform 230 is in the horizontal loading position. Additionally, a rear edge of the top platform 230 preferably includes a down-turned extension 260 which overlaps the second vertical segment 256 of the offset edge piece 250 as shown in FIG. 4. The downward extension 260 of the platform 230 preferably fits within the offset region between the rear wall 210 and the second vertical segment 256 and provides lateral stability to the platform 230 when the platform is supporting the container 200. Additional lateral support for the platform 230 is provided by the two partial front walls 224 and 226 as shown in FIGS. 2 and 4.

A top surface of the top platform 230 preferably includes a vertically extending container stop 264 that extends across a majority of the width of the platform 230 between the rear wall 210 and the open front of the fill station 114 between the two partial front walls 224 and 226 (best shown in FIG. 4). The container stop 264 is positioned to support a rear edge of the container 200 when the container 200 is properly positioned on the platform 230 below the product discharge tube 202. As best shown in FIG. 2, the top platform 230 further defines a central slot 268 extending from the right edge of the platform 230 to a point just to the right of the container stop 264. The slot 268 is wider than the diameter of the discharge tube 202 and provides for clearance with respect to the tube 202 when the top platform 230 is raised as shown in FIG. 5. Specifically, the end of the discharge tube 202 passes through the slot 268 as the platform 230 is raised from the horizontal position shown in FIG. 2 to the stowed position shown in FIG. 5. In this manner, the slot 268 allows the product discharge tube 202 to remain fixed in place, even as the top platform 230 is raised and lowered, thereby helping to prevent spills during use of the fill station 114.

The middle platform 232 is similar to the top platform 230 except that the middle platform is hinged on its right end so that the left end of the platform is raised upward (to provide access to the bottom platform 234) as shown in FIG. 6. FIGS. 3 and 5 illustrate a hinge 270 having a fixed portion 272 secured to a hinge angle or horizontal mounting plate 274 that extends from the right side wall 214 between the rear wall 210 and the partial front wall 226 as shown in FIGS. 2, 3 and 5. In this manner, the hinge 270 allows a left end of the middle platform 232 to be pivoted about the hinge axis so that the free end is lifted upward to a stowed position. In the horizontal loading position of the middle platform 232 shown in FIG. 3, the free left end of the platform 232 is supported by a horizontal stop 278 attached to the left side wall 212 and extending between the rear wall 210 and the partial front wall 224.

To provide added support for the middle platform 232 (and specifically to keep the platform from sagging in the middle region where the container 236 is supported), an offset edge piece 280 is preferably attached along the rear wall 210 as shown in FIGS. 3 and 4. The offset edge piece 280 preferably comprises a double angle bracket having a first vertical segment 282 attached to the rear wall 210, a horizontal segment 284 extending laterally away from the rear wall 210, and a second vertical segment 286 extending upward from the horizontal segment 284. The second vertical segment 286 defines a horizontally extending edge that is offset from the rear wall 210 by the length of the horizontal segment 284. In this manner, the horizontally extending edge of the second vertical segment 286 supports a bottom surface of the middle platform 232 when the platform 232 is in a horizontal loading position. Specifically, the horizontally extending edge of the second vertical segment 286 is preferably coplanar with a top surface of the horizontal stop 278 (and a top surface of the hinge 270) to provide a substantially horizontal support surface for the middle platform 232 when the platform 232 is in the horizontal loading position. Additionally, a rear edge of the middle platform 232 preferably includes a down-turned extension 290 which overlaps the second vertical segment 286 of the offset edge piece 280 as shown in FIG. 4. The downward extension 290 of the platform 232 preferably fits within the offset region between the rear wall 210 and the second vertical segment 286 and provides lateral stability to the platform 232 when the platform is supporting the medium-sized (e.g., 2.5 gallon) container 236 as shown in FIG. 5. Additional lateral support for the platform 232 is provided by the two partial front walls 224 and 226 as shown in FIGS. 4 and 5.

A top surface of the middle platform 232 preferably includes a vertically extending container stop 294 that extends across a majority of the width of the platform 232 between the rear wall 210 and the open front of the fill station 114 between the two partial front walls 224 and 226 (best shown in FIG. 4). The container stop 294 is positioned to support a rear edge of the medium-sized container 236 when the container 236 is properly positioned on the platform 232 below the product discharge tube 202. As shown in FIG. 4, the height of the container stop 294 is necessarily smaller than the vertical distance between the middle platform 232 and the top platform 230 to provide clearance for the container stop 294 when the top platform 230 is in the horizontal loading position. Additionally, while not shown in the embodiment of the invention shown in the drawing, the left end of the middle platform 232 may define a central slot similar to the slot 268 defined in the top platform 230 if necessary to provide clearance for the discharge tube 202. Because the discharge tube 202 is positioned to the left side of the fill station 114 in the exemplary embodiment shown in the drawing, no such slot is necessary for the middle platform 232 of the preferred embodiment since the left end of the platform 232 will clear the bottom of the discharge tube 202. However, if the discharge tube 202 were to extend lower, or if the tube 202 was positioned to the right side of the fill station 114, a slot could be formed in the left end of the middle platform 232 to provide clearance for the discharge tube 202.

The bottom platform 234 differs from the top and middle platforms 230 and 232 in that the bottom platform 234 is not hinged. Specifically, because the bottom platform 234 is adapted to hold the largest container 238 (e.g. 5 gallons) used with the fill station 114, there is no need to hinge the bottom platform 234. However, the bottom platform is preferably removable from the fill station to allow for access to the drain pan below the platform 234 (e.g., for cleaning the bottom wall 216 and for accessing the drain outlet 220). FIGS. 3 and 4 illustrate that the right end of the bottom platform 234 is supported by a horizontal support or base 304 that extends from the right side wall 214 between the rear wall 210 and the partial front wall 226. Similarly, the left end of the bottom platform 234 is supported by a horizontal base 306 that extends from the left side wall 212 between the rear wall 210 and the partial front wall 224.

To provide added support for the middle platform 232 (and specifically to keep the platform from sagging in the middle region where the large-sized container 238 is supported), an offset edge piece 310 is preferably attached along the rear wall 210 as shown in FIGS. 3 and 4. The offset edge piece 310 preferably comprises a double angle bracket having a first vertical segment 312 attached to the rear wall 210, a horizontal segment 314 extending laterally away from the rear wall 210, and a second vertical segment 316 extending upward from the horizontal segment 314. The second vertical segment 316 defines a horizontally extending edge that is offset from the rear wall 210 by the length of the horizontal segment 314. In this manner, the horizontally extending edge of the second vertical segment 316 supports a bottom surface of the bottom platform 234 when the platform 234 is fixed in place above the drain pan. Specifically, the horizontally extending edge of the second vertical segment 316 is preferably coplanar with a top surface of the right and left horizontal bases 304 and 306, respectively, to provide a substantially horizontal support surface for the bottom platform 234. Additionally, a rear edge of the bottom platform 234 preferably includes a down-turned extension 320 which overlaps the second vertical segment 316 of the offset edge piece 310 as shown in FIG. 4. The downward extension 320 of the platform 234 preferably fits within the offset region between the rear wall 210 and the second vertical segment 316 and provides lateral stability to the platform 234 when the platform is supporting a large-sized container 238 (FIG. 6). Additional lateral support for the platform 234 is provided by the two partial front walls 224 and 226 as shown in FIG. 6.

A top surface of the bottom platform 234 preferably includes a vertically extending container stop 324 that extends across a majority of the width of the platform 234 between the rear wall 210 and the open front of the fill station 114 between the two partial front walls 224 and 226 (best shown in FIG. 4). The container stop 324 is positioned to support a rear edge of the large-sized container 238 when the container 238 is properly positioned on the platform 234 below the product discharge tube 202. As shown in FIG. 4, the height of the container stop 324 is necessarily smaller than the vertical distance between the bottom platform 234 and the middle platform 232 to provide clearance for the container stop 324 when the middle platform 232 is in the horizontal loading position.

The system of pivoting platforms 230 and 232 works in conjunction with the formulator 102 to ensure that each of the three different sized containers (200, 236 and 238) are matched with their respective platforms (230, 232 and 234) prior to the initiation of the container filling procedure. Additionally, to ensure that a fill station operator does not accidentally (or intentionally) place an improper container on one of the lower platforms (e.g., a small container 200 on the middle platform 232 or a medium container 236 on the bottom platform 234), the fill station 114 preferably employs a sensor 350 to detect the presence of a properly sized container. In the preferred embodiment, the sensor 350 comprises an infrared sensor positioned in above the container handle 352. In the specific preferred embodiment of the chemical dispensing system 100 shown in FIGS. 2, 5 and 6, the sensor 350 is mounted in a bottom surface of the formulator 102 (shown in phantom in FIGS. 2, 5 and 6) so that the sensor 350 is positioned approximately six inches above the container handle 352. However, other types of known proximity sensors, such as optical sensors and mechanical sensors, may be used in place of the infrared sensor 350. Additionally, alternative means for mounting the sensor above the container may be used (e.g., when the fill station 114 is used separately from the formulator 102). Furthermore, while the sensor 350 is preferably positioned above the handle 352, other positions for the sensor 350 may be used provided that the sensor 350 can accurately detect the presence and proper position of a container. In one example shown in FIG. 3, an alternative sensor 350' is positioned within the rear wall 210 of the fill station 114 so that the sensor 350' is pointing at a top portion of the container immediately below the handle 352.

The three different sized containers (200, 236 and 238) are preferably selected so that the handles 352 of each container are properly positioned (e.g., approximately six inches) below the sensor 350 when the container (200, 236 or 238) is in on the proper platform (230, 232 and 234, respectively). In this manner, the sensor 350 detects the presence of a container near the end of the discharge tube 202 so that a container that is too small cannot be filled from one of the lower platforms. For example, if a fill station operator attempts to fill a small-sized container 200 while one or both of the top and middle platforms 230 and 232 are raised, the handle 352 of the container 200 will not be detected by the sensor 350. Specifically, the sensor 350 may only have a detection zone of eight inches extending downward from the level of the sensor 350, and the handle 352 of the small container 200 would be more than eight inches below the sensor 350 when the container 200 is not on the top platform 230. In the exemplary embodiment of the present invention, the formulator 102 is programmed to disable delivery of the chemical product to the discharge tube 202 when the sensor 350 does not detect the presence of a properly sized container.

Thus, the sensor 350 is used to detect and prevent improper usage of the fill station 114 by checking to see if the proper sized container is being used with the appropriate platform. The sensor 350 also acts as a safety check to ensure that the operator has not forgotten to place a container in the fill station 114 prior to delivering the requested chemical formulation. Specifically, if the operator selects the proper platform (e.g., the middle platform 232) for the requested amount of the chemical mixture (e.g., 2.5 gallons), but the operator simply forgets to place the container 236 on the platform, the sensor 350 will detect the omission and instruct the formulator 102 not to dispense the requested amount until a properly sized container is detected on the platform.

In sum, the combination of the sensor 350 with the container stops (264, 294 and 324) for each of the platforms (230, 232 and 234) ensures that a container is properly positioned beneath the product discharge tube 202. The fill station 114 thus reduces or eliminates the types of operator errors that can lead to excess spillage of the chemical formulations, such as when an operator might attempt to fill a small-sized container from one of the lower platforms. Indeed, one of the few remaining possibilities for operator error would be a miscommunication such as when an operator properly sets up a small-sized container 200 on the top platform 230 and then requests the formulator to supply more than 1.5 gallons of the chemical substance. The sensor 350, by itself, could not prevent such a mistake since the sensor 350 correctly detects the presence of the container 200. However, an alternative embodiment of the present invention addresses this particular problem through the inclusion of sensors to detect the position of each of the movable platforms (e.g., the top and middle platforms 230 and 232).

For example, mechanical contact sensors (not shown) may be placed on the horizontal stops 248 and 278 to detect when the respective platforms 230 and 232 are lowered. By using both the platform position sensors and the sensor 350, the formulator 102 could be programmed to detect not only the presence of a container but also the size of the container. For example, if the platform position sensors detect that the top platform 230 is up and that the middle platform 232 is down, and the optical sensor 350 further detects the presence of a container, the formulator would be programmed to determine that a medium-sized container 236 is present in the fill station 114. The formulator 102 could then be programmed to check the requested chemical formula delivery amount against the size of the detected container (e.g., 2.5 gallons) and could be programmed to disable product delivery if a discrepancy is noted.

Specifically, in one embodiment of the invention, the formulator 102 is programmed to refuse to initiate the filling procedure if the requested product amount could not be accommodated within the detected container. For example, if the fill station sensors detect that a medium-sized (e.g., 2.5 gallon) container is present in the fill station 114, and the operator requests that 5 gallons of a certain chemical formulation be delivered to the container, the formulator would alert the operator to the discrepancy and disable delivery of the chemical product until either the requested volume or the detected container is changed to match the other.

The design of the fill station 114 shown in FIGS. 1–6 preferably matches the design of the formulator 102 as shown in FIG. 1. Specifically, the fill station 114 is preferably wall mounted directly below the formulator 102 through the use of keyed slots 360 formed at the top of the rear wall 210. Additionally, a bottom mounting plate 362 is preferably formed to depend from a bottom portion of the rear wall 210 (FIG. 4) so that the mounting plate 362 extends down beyond the slanting bottom wall 216 as shown in FIG. 3. The bottom mounting plate 362 also includes a number of holes 364 for securing the rear wall 210 of the fill station 114 to the wall below the formulator 102. Positioned in this manner, the fill station 114 is able to receive not only the product discharge tube 202 from the formulator 102, but also a drain line 370 that extends from the bottom of the formulator 102. The drain line 370 is best shown in FIG. 3 where it extends vertically along the junction of the rear wall 210 and the left side wall 212. A drain hose shield 372 attached to the top of the left side wall 212 includes an opening for receiving the drain line 370. Additionally, each of the fixed horizontal mounting plates/stops 244, 278 and 306 (FIG. 3) on the left side of the fill station 114 includes an opening (not shown) in a corner thereof to allow passage of the drain line 370 down into the drain pan of the fill station 114. A terminal end 374 (FIG. 3) of the drain line 370 preferably extends to the bottom of the drain pan and, in one embodiment, extends into the drain outlet 220 itself. The drain line 370 thus allows the formulator 102 to drain excess chemicals to the drain pan of the fill station 114 so that an additional external drain line from the formulator 102 to the floor drain 118 (FIG. 1) is not required. The drain hose shield 372 is preferably positioned sufficiently high on the left side wall 212 to avoid contact with the right end of the top platform 230 when the top platform 230 is in a raised position as shown in FIGS. 5 and 6.

While the fill station 114 provides a drainage area for the formulator 102 via the drain line 370, it is important to note that the drain pan of the fill station 114 also collects any chemicals spilled during the container filling process. While the present invention is designed to prevent or at least minimize such spills by ensuring proper positioning of the containers 200, 236 and 238, some spillage is inevitable with repeated use of the fill station. For this reason, each of the platforms 230, 232 and 234 includes a plurality of perforations 380 (FIG. 2) that allow for passage of any spilled chemicals to the platform below and ultimately to the bottom wall 216 of the fill station 114. The slanted surface of the bottom wall 216 ensures that spilled chemicals will be directed to the drain outlet 220 and then through the drain line 116 (FIG. 1) to the floor drain 118 or other specified receptacle. In this manner, each of the platforms 230, 232 and 234 are essentially formed as grates or screens which may be easily cleaned by spraying water on the platforms and allowing the water to drain downward to the drain pan of the fill station 114.

Furthermore, the drain pan of the fill station 114 preferably includes an auxiliary drain inlet 390 formed in the left side wall 212 below the level of the bottom platform 234, as best shown in FIG. 3. The drain inlet 390 can receive a drain hose from another component of the chemical dispensing system 100 other than the formulator 102, such as a discharge hose from an alkaline station (not shown).

It will be clear that the present invention is well adapted to attain the ends and advantages mentioned as well as those inherent therein. Specifically, the fill station 114 is adapted to reduce product spillage when containers of varying sizes are filled from a formulator or allocator of a chemical dispensing system 100. While a presently preferred embodiment of the fill station 114 has been described for purposes of this disclosure, numerous changes may be made which will readily suggest themselves to those skilled in the art and which are encompassed in the spirit of the invention disclosed and as defined in the appended claims.

What is claimed is:

1. A fill station for filling containers of varying sizes from a liquid dispensing system, the fill station comprising:

a drain outlet;

a first platform positioned above the drain outlet for holding a first container;

a second platform positioned above the first platform for holding a second container smaller in size than the first container, wherein the second platform is hinged to move between a horizontal loading position for holding the second container and a stowed position to provide access to the first platform for loading the first container on the first platform; and a third platform positioned above the second platform for holding a third container smaller in size than the second container, wherein the third platform is hinged to move between a horizontal loading position for holding the third container and a stowed position to provide access to the first and second platforms.

2. A fill station as defined in claim 1 further comprising:

a sensor for detecting whether a container is positioned on one of the platforms to receive product from the liquid dispensing system.

3. A fill station as defined in claim 2 further comprising:

a position sensor for determining whether at least one of the second platform and the third platform is in the horizontal loading position.

4. A fill station as defined in claim 1 wherein:

the second platform is hinged at a first end to allow the second platform to pivot in a first direction between the horizontal loading position and the stowed position; and the third platform is hinged at a second end to allow the third platform to pivot in a second direction between the horizontal loading position and the stowed position, wherein the second direction is different than the first direction.

5. A fill station as defined in claim 4 further comprising:

a sensor for detecting whether a container is positioned on one of the platforms to receive product from the liquid dispensing system.

6. A fill station as defined in claim 5 further comprising:

position sensors for each of the second and third platforms for determining whether each of the second and third platforms are in their respective horizontal loading position.

7. A fill station as defined in claim 4 wherein the first, second and third platforms are each perforated to allowed spilled liquid to drain through each of the platforms to the drain outlet below the first platform.

8. A fill station as defined in claim 7 wherein the first platform is removable from the fill station to provide access to the drain outlet.

9. A fill station as defined in claim 4 wherein each of the first, second and third platforms includes a container stop extending vertically upward from the platform to properly position the first, second and third containers, respectively, relative to a product discharge tube of the liquid dispensing system.

10. A fill station as defined in claim 9 further comprising:

a sensor for detecting whether a container is positioned on one of the platforms in proximity to the product discharge tube to receive product from the liquid dispensing system.

11. A fill station as defined in claim 4 wherein:

the fill station further comprises a bottom wall, a rear wall, left and right side walls, and a lower front wall extending upward from the bottom wall, the walls combining to form a drain pan below the first platform; and the bottom wall is slanted to direct fluid in the drain pan toward the drain outlet.

12. A fill station as defined in claim 11 wherein the stowed position of the third platform is along the left side wall and the stowed position of the second platform is along the right side wall to provide access to the first platform for loading the first container on the first platform.

13. A fill station as defined in claim 12 wherein the third platform defines a slot extending from a right end of the platform to provide clearance for a product discharge tube of the liquid dispensing system as the third platform is pivoted between the horizontal loading position and the stowed position.

14. A fill station as defined in claim 11 wherein the rear wall includes offset edge pieces for each of the first, second and third platforms to support a rear edge of each platform when the platform is positioned horizontally to receive a container.

15. A fill station as defined in claim 14 wherein the rear edge of each of the first, second and third platforms includes a down-turned extension fitting between the rear wall and a vertical extension of the offset edge piece when the platform is positioned horizontally to receive a container.

16. A fill station as defined in claim 11 wherein the rear wall includes holes for mounting the fill station to a wall below a product discharge tube of the liquid dispensing system.

17. A fill station as defined in claim 16 further comprising:

a drain line having a first end adapted to be connected to the liquid dispensing system, the drain line extending downward through each of the three platforms so that a terminal end of the drain line extends below the first platform to discharge liquid contents of the drain line into the drain pan of the fill station.

18. A fill station for filling containers of varying sizes from a liquid dispensing system, the fill station comprising:

a frame including a bottom wall, a rear wall, left and right side walls, and a lower front wall, wherein the walls combine to form a drain pan and the bottom wall includes a drain outlet;

a stationary platform positioned above the drain outlet;

a first rotatable platform positioned above the stationary platform, the first rotatable platform hinged to move between a horizontal loading position and a substantially vertical stowed position; and a second rotatable platform positioned above the first rotatable platform, the second rotatable platform hinged to move between a horizontal loading position and a substantially vertical stowed position.

19. A fill station as defined in claim 18 further comprising:

a sensor for detecting whether a container is positioned on one of the platforms to receive product from the liquid dispensing system.

20. A fill station as defined in claim 19 further comprising:

a position sensor for determining the position of at least one of the rotatable platforms.

21. A fill station as defined in claim 18 wherein:

the first rotatable platform is hinged at a first end; and the second rotatable platform is hinged at a second end different from the hinged first end of the first rotatable platform.

22. A fill station as defined in claim 21 further comprising:

a sensor for detecting whether a container is positioned on one of the platforms to receive product from the liquid dispensing system.

23. A fill station as defined in claim 22 further comprising:

position sensors for determining the position of each of the first and second rotatable platforms.

24. A fill station for filling containers of varying sizes from a liquid dispensing system, the fill station comprising:

a frame including a bottom wall, a rear wall, left and right side walls, and a lower front wall, wherein the walls combine to form a drain pan and the bottom wall includes a drain outlet;

a bottom platform positioned above the drain outlet, the bottom platform adapted to properly position a large-sized container beneath a product discharge tube of the liquid dispensing system;

a middle platform positioned above the bottom platform, the middle platform hinged at one end to move between a horizontal loading position and a substantially vertical stowed position for providing access to the bottom platform, wherein the middle platform is adapted to properly position a medium-sized container beneath the product discharge tube of the liquid dispensing system when the middle platform is in the horizontal loading position; and a top platform positioned above the middle platform, the top platform hinged at one end opposite the hinged end of the middle platform to move between a horizontal loading position and a substantially vertical stowed position for providing, access to the middle platform, wherein the top platform is adapted to properly position a small-sized container beneath the product discharge tube of the liquid dispensing system when the top platform is in the horizontal loading position.

25. A fill station as defined in claim 24 further comprising:

a sensor for detecting whether a container is positioned on one of the platforms in proximity to the product discharge tube of the liquid dispensing system.

26. A fill station as defined in claim 25 further comprising:

position sensors for determining the position of each of the middle and top platforms.

* * * * *